US009834332B2

(12) United States Patent
Luo

(10) Patent No.: US 9,834,332 B2
(45) Date of Patent: Dec. 5, 2017

(54) MACHINE CORE OF A PACKING MACHINE

(71) Applicant: HANGZHOU YOUNGSUN INTELLIGENT EQUIPMENT CO., LTD., Hangzhou, Zhejiang (CN)

(72) Inventor: Bangyi Luo, Zhejiang (CN)

(73) Assignee: Hangzhou Youngsun Intelligent Equipment Co., Ltd., Hangzhou, Zhejiang Province (CN)

( * ) Notice: Subject to any disclaimer, the term of this patent is extended or adjusted under 35 U.S.C. 154(b) by 134 days.

(21) Appl. No.: 14/769,282

(22) PCT Filed: Mar. 11, 2013

(86) PCT No.: PCT/CN2013/072404
§ 371 (c)(1),
(2) Date: Aug. 20, 2015

(87) PCT Pub. No.: WO2014/127549
PCT Pub. Date: Aug. 28, 2014

(65) Prior Publication Data

US 2016/0001910 A1 Jan. 7, 2016

(30) Foreign Application Priority Data

Feb. 22, 2013 (CN) ..... 2013 1 0056243
Feb. 22, 2013 (CN) ..... 2013 2 0081348 U

(51) Int. Cl.
*B65B 65/02* (2006.01)
*B65B 13/22* (2006.01)
*B65B 13/32* (2006.01)

(52) U.S. Cl.
CPC ..... *B65B 65/02* (2013.01); *B65B 13/22* (2013.01); *B65B 13/32* (2013.01)

(58) Field of Classification Search
CPC ..... B65B 13/18; B65B 13/22; B65B 13/32; B65B 65/02
See application file for complete search history.

(56) References Cited

U.S. PATENT DOCUMENTS 4,288,270 A * 9/1981 Mossell ..... B29C 65/02 100/33 PB
4,559,767 A * 12/1985 Takami ..... B65B 13/184 100/32

(Continued)

FOREIGN PATENT DOCUMENTS

CN 1235920 A 11/1999
CN 2707622 Y 7/2005
CN 201189961 Y 2/2009

*Primary Examiner* — R. K. Arundale
*Assistant Examiner* — Mohammad Yusuf
(74) *Attorney, Agent, or Firm* — Muncy, Geissler, Olds & Lowe, P.C.

(57) ABSTRACT

A machine core of a packing machine, a strap feeding and returning and strap tightening device thereof includes a first roller (1) and a second roller (2). The second roller (2) is controlled by a control mechanism to move to a first matching state with the first roller (1) and to move out of the first matching state with the first roller (1) to a second matching state. The first roller (1) is connected with a first transmission gear (10) capable of driving the first roller (1) to rotate. The second roller (2) is connected with a second transmission gear (20) capable of driving the second roller (2) to rotate. The second transmission gear (20) and the second roller (2) conduct synchronous movement. The first transmission gear (10) takes in power through a gear transmission mechanism to drive the first roller (1) to rotate. The second transmission gear (20) takes in power through the gear transmission mechanism. The second transmission gear (20) moves into a first gear matching state with a gear transmitting the power to the second transmission gear (20)

(Continued)

through the movement, and moves out of the first gear matching state. The machine core has a simple structure, is capable of reducing failure rate, and has a good packing effect. Besides, strapping force, strap feeding length and temperature as well as ironing adhering delay may be regulated by means of a potentiometer.

8 Claims, 9 Drawing Sheets

(56) References Cited

U.S. PATENT DOCUMENTS

| | | | | | |
|---|---|---|---|---|---|
| 4,683,017 | A * | 7/1987 | Figiel | B65B 13/02 | 100/2 |
| 4,850,179 | A * | 7/1989 | Takami | B65B 13/32 | 100/26 |
| 4,850,180 | A * | 7/1989 | Takami | B65B 13/32 | 100/26 |
| 4,938,009 | A * | 7/1990 | Takami | B65B 13/18 | 100/26 |
| 5,379,576 | A | 1/1995 | Koyama | | |
| 5,640,899 | A * | 6/1997 | Bell | B65B 13/16 | 100/2 |
| 6,041,698 | A * | 3/2000 | Chin-Chang | B65B 13/22 | 100/26 |
| 6,155,032 | A | 12/2000 | Lai | | |
| 6,530,194 | B2 * | 3/2003 | Shibazaki | B65B 13/32 | 100/29 |
| 6,568,158 | B2 * | 5/2003 | Shibazaki | B65B 13/22 | 100/29 |
| 2003/0159409 | A1 | 8/2003 | Oda et al. | | |
| 2008/0302551 | A1 * | 12/2008 | Komuro | B25F 5/008 | 173/217 |

* cited by examiner

MACHINE CORE OF A PACKING MACHINE

TECHNICAL FIELD

The invention relates to a machine core of a packing machine.

BACKGROUND OF THE INVENTION

A packing machine is a device for strapping articles by packing straps, the whole packing process includes such steps as strap feeding, strap returning, tightening and ironing adhering, and these movements are mainly undertaken by the packing machine. A previous machine core is unstable in strapping force, complex in structure, uses gear engagement, a suction tube and an inductive switch to control tightening, and has more fault points.

SUMMARY OF THE INVENTION

The invention is intended to solve a technical problem by providing a machine core of a packing machine, which has a simple structure, reduced failure rate, and good packing. For this purpose, the invention adopts a technical solution as below: a machine core of a packing machine includes a packing strap ironing adhering and strap cutting mechanism and an ironing adhering sliding board mechanism, wherein the machine core is further provided with a strap feeding and returning and strap tightening device, which includes an unmovable first roller and a movable second roller, the second roller is controlled by a control mechanism to move to a first matching state with the first roller and to move out of the first matching state with the first roller to a second matching state, the first matching state is a state in which the second roller and the first roller are in contact with and cooperating with one another for strap returning and tightening, and the second matching state is a state in which the second roller and the first roller are in contact with and cooperating with one another for strap feeding; the first roller is connected with a first transmission gear capable of driving the first roller to rotate, the second roller is connected with a second transmission gear capable of driving the second roller to rotate, and the second transmission gear synchronously shifts with the second roller; the first transmission gear takes in power through a gear transmission mechanism to drive the first roller to rotate, the second transmission gear takes in power through the gear transmission mechanism; the second transmission gear moves into a first gear matching state with a gear transmitting the power to the second transmission gear through the movement, and moves out of the first gear matching state, the first gear matching state is a meshing state, and the state after moving out of the first gear matching state is an out-of-gear state or a meshing state looser than the first gear matching state; and the power is supplied by a drive motor.

On the basis of adoption of the technical solution mentioned above, the invention also may further adopt such a technical solution as below.

The drive motor first inputs power to the first transmission gear through gear reduction transmission, and then transmits the power from the first transmission gear to the second transmission gear through tooth mesh.

The first transmission gear is coaxial with the first roller, and the second transmission gear is coaxial with the second roller.

The control mechanism includes a machine core spindle and a spindle motor. The machine core spindle is provided with a plurality of cams for controlling the ironing adhering and strap cutting mechanism and the ironing adhering sliding board mechanism, and a strap tightening cam for controlling the second driven roller to move. The spindle motor drives the machine core spindle to rotate by means of a decelerating mechanism.

The second transmission gear and the second roller are arranged in a swing system, and the strap tightening cam controls the second transmission gear and the second roller to move by means of the swing system having a reset spring, a regulating spring and a stretched spring.

The swing system includes a first swing arm which is provided with a roller matching with the cam; the first swing arm is connected with a pull rod by means of a lower cardan connector, the pull rod is sleeved with the regulating spring which may be regulated by a nut on the pull rod, the regulating spring acts on an upper cardan connector to regulate force tightening the packing strap, the upper cardan connector is connected with a second swing arm, the second transmission gear and the second roller are arranged on the second swing arm, the second swing arm is connected to the stretched spring, and the reset spring acts on the first swing arm by means of the lower cardan connector.

The strap feeding and returning and strap tightening device is further provided with a rack, a shaft between the first transmission gear and the first roller passes through the rack, a shaft of the second swing arm is also arranged on the rack, the second swing arm is positioned above the shaft between the first transmission gear and the first roller; the second roller and the second transmission gear are respectively positioned above the first roller and the first transmission gear, the first transmission gear is meshed with the second transmission gear, and is a gear for transferring power to the second transmission gear.

The machine core spindle is further provided with a first inductive cam, and the machine core is internally provided with a first inductor matching with the first inductive cam and a second inductor matching with the strap tightening cam; signal generated by matching of the first inductive cam with the first inductor is configured to ensure a controller of the control mechanism to control an operation state of the spindle motor and the drive motor of the first roller in a packing cycle, and signal generated by matching of the strap tightening cam with the second inductor is configured to ensure the controller of the control mechanism to control the spindle motor to drive the spindle to reset and to control the drive motor of the first roller to rotate for strap feeding after a packing cycle is completed.

The decelerating mechanism includes a motor shaft gear, a first gear, a second gear and a machine core spindle gear, the motor shaft gear is engaged with the first gear, the first gear is coaxial with the second gear, the second gear is engaged with the machine core spindle gear, the motor shaft gear and the first gear constitute a speed reducing gear pair, and the second gear and the machine core spindle gear constitute a speed reducing gear pair.

The packing machine is provided with a machine core mounting rack, and the machine core spindle penetrates through the machine core mounting rack; both the spindle motor and the decelerating mechanism are positioned outside one side of the machine core mounting rack, and the decelerating mechanism is externally provided with a housing; a plurality of cams for controlling the ironing adhering and strap cutting mechanism and the ironing adhering sliding board mechanism are positioned on the machine core spindle in the machine core mounting rack, and the strap tightening cam and the first inductive cam are arranged on the machine core spindle positioned outside one side of the machine core mounting rack.

The machine core is provided with a dust-collecting fan at a side where an ironing board is arranged and at an end above the machine core and close to the spindle motor, and the dust-collecting fan has an upward air-sucking direction.

Due to adoption of the technical solution of the invention, the machine core of the invention may achieve strap feeding, returning and tightening only by using a pair of rollers, the structure is simple, the failure rate is reduced, and the packing effect is good. Besides, strapping force, strap feeding length and temperature as well as ironing adhering delay may be regulated by means of a potentiometer.

DETAILED DESCRIPTION OF THE EMBODIMENTS

Figure 1:
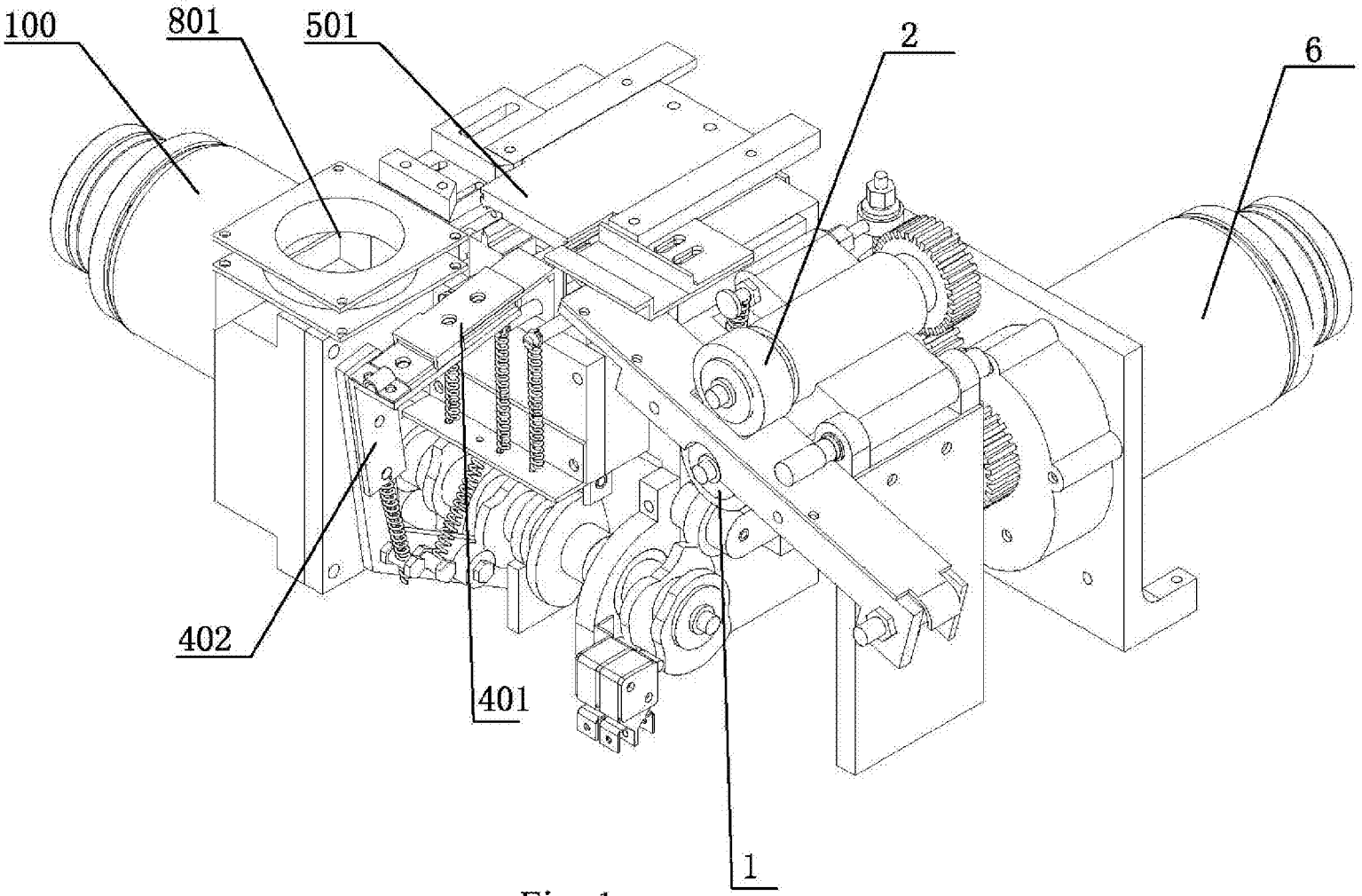
FIG. 1 is a three-dimensional schematic diagram of an embodiment according to the invention.
Figure 2:
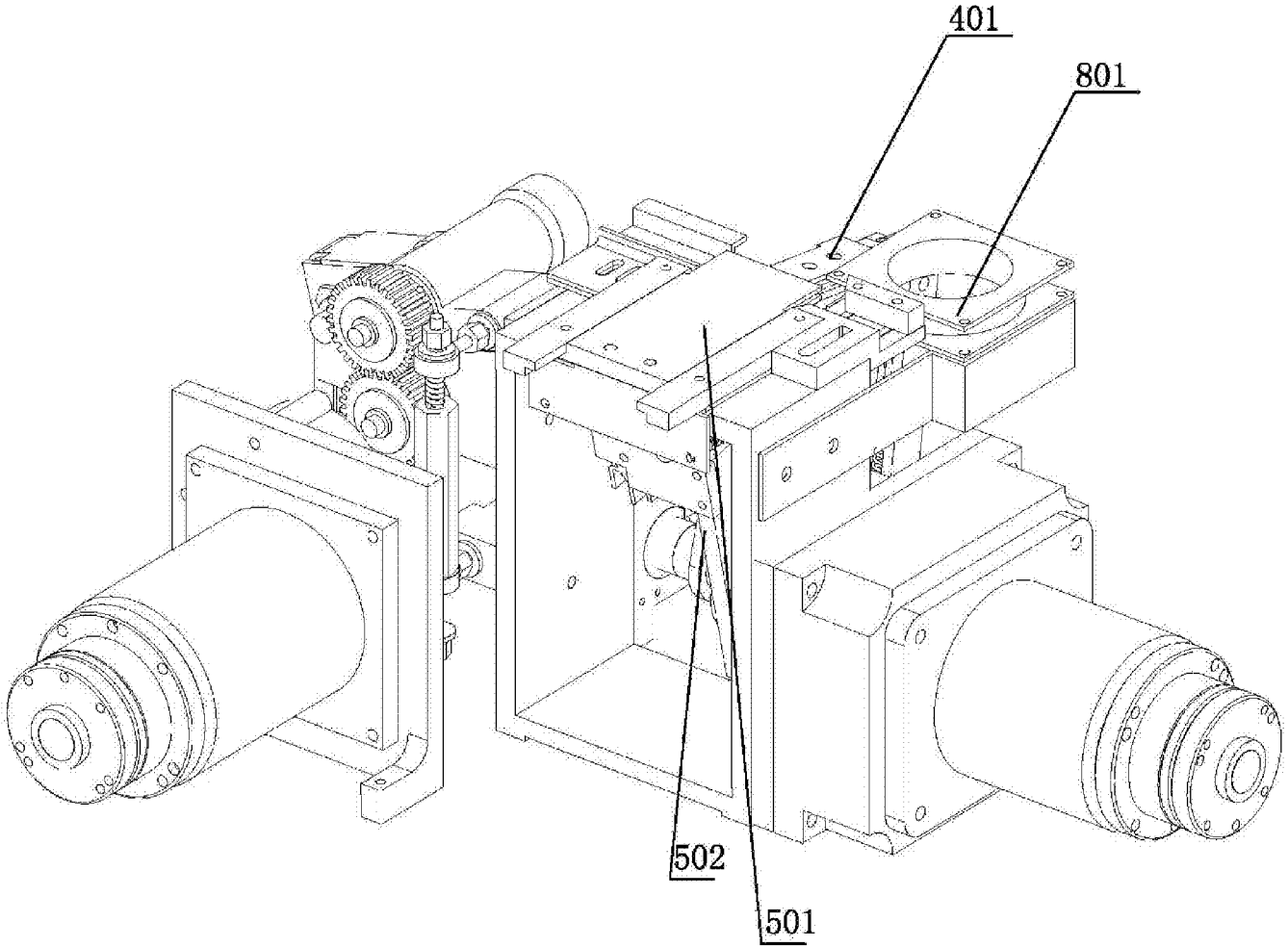
FIG. 2 is a three-dimensional schematic diagram of the embodiment according to the invention observed from another direction.

Referring to Figs., the machine core of a packing machine includes a packing strap ironing adhering and strap cutting mechanism, an ironing adhering sliding board mechanism and a control mechanism, the control mechanism includes a machine core spindle and a spindle motor 100, the machine core spindle is provided with a plurality of cams for controlling the ironing adhering and strap cutting mechanism and the ironing adhering sliding board mechanism; the machine core is further provided with a strap feeding and returning and strap tightening device, which includes an unmovable first roller 1 and a movable second roller 2, the second roller 2 is controlled by the control mechanism to move to a first matching state with the first roller 1 and to move out of the first matching state with the first roller 1 to a second matching state, the first matching state is a state in which the second roller 2 and the first roller 1 are in contact with and cooperating with one another for strap returning and tightening, and the second matching state is a state in which the second roller 2 and the first roller 1 are in contact with and cooperating with one another for strap feeding; in the first matching state the first roller 1 and the second roller 2 are in contact with one another more tightly than in the second matching state; the first roller 1 is connected with a first transmission gear 10 capable of driving the first roller to rotate, the second roller 2 is connected with a second transmission gear 20 capable of driving the second roller to rotate, and the second transmission gear 20 synchronously shifts with the second roller 2; the first transmission gear 10 takes in power through a gear transmission mechanism to drive the first roller 1 to rotate, the second transmission gear 20 takes in power through the gear transmission mechanism; the second transmission gear 20 moves into a first gear matching state with a gear transmitting the power to the second transmission gear through the movement, and moves out of the first gear matching state, the first gear matching state is a meshing state, and the state after moving out of the first gear matching state is an out-of-gear state or a meshing state looser than the first gear matching state; the strap tightening cam 3 is arranged on the machine core spindle, the spindle motor 100 drives the machine core spindle 101 to rotate by means of a decelerating mechanism; and the power is supplied by a drive motor 6.

In the first matching state, the second roller mainly relies on drive of the second transmission gear to rotate; in the second matching state, when the state after moving out of the first gear matching state is the out-of-gear state, the second roller is driven by friction to rotate, when the state after moving out of the first gear matching state is the meshing state looser than the first gear matching state, the second roller is driven by combination of friction and gear transmission to rotate.

The drive motor 6 first inputs power to the first transmission gear 10 through gear reduction transmission, and then transmits the power from the first transmission gear 10 to the second transmission gear 20 through tooth mesh.

The first transmission gear 10 is coaxial with the first roller 1, and the second transmission gear 20 is coaxial with the second roller 2.

The second transmission gear 20 and the second roller 2 are arranged in a swing system, and the strap tightening cam 3 controls the second transmission gear 20 and the second roller 2 to move by means of the swing system having a reset spring, a regulating spring and a stretched spring. The swing system includes a first swing arm 41 which is provided with a roller 42 matching with the strap tightening cam 3; the first swing arm 41 is connected with a pull rod 44 by means of a lower cardan connector 43, the pull rod 44 is sleeved with the regulating spring 46 which may be regulated by a nut 45 on the pull rod, the regulating spring 46 acts on an upper cardan connector 47 to regulate force tightening the packing strap, the upper cardan connector 47 is connected with a second swing arm 48, the second transmission gear 20 and the second roller 2 are arranged on the second swing arm 48, the second swing arm 48 is connected to the stretched spring 49, the stretched spring 49 guarantees a stable matching state in which the first roller 1 and the second roller 2 as well as the first transmission gear 10 and the second transmission gear 20 are situated; and the reset spring 50 acts on the first swing arm 41 by means of the lower cardan connector 43 so that the strap tightening cam clings to rollers.

The strap feeding and returning and strap tightening device is further provided with a rack 51, a shaft 11 between the first transmission gear 10 and the first roller 1 passes through the rack, a shaft 52 of the second swing arm 48 is also arranged on the rack 51, the second swing arm 48 is positioned above the shaft 11 between the first transmission gear 10 and the first roller 1.

The second roller 2 and the second transmission gear 20 are respectively positioned above the first roller 1 and the first transmission gear 10, the first transmission gear 10 is meshed with the second transmission gear 20, and is a gear for transferring power to the second transmission gear.

The ironing adhering and strap cutting mechanism includes an ironing board 401 arranged on a swing arm 402, a left cutter 211, a middle cutter 212 and a right cutter 213 of the ironing adhering and strap cutting mechanism, the ironing adhering and strap cutting mechanism is further provided with a guide part 202 arranged on a machine core mounting rack 104, the guide part constitutes a part of the machine core rack. The guide part is internally provided with a vertical lifting guide hole 221 for the left cutter, a vertical lifting guide hole 222 for the middle cutter, and a vertical lifting guide hole 223 for the right cutter; the ironing adhering and strap cutting mechanism is further provided with a left cutter guide pillar 231, a middle cutter guide pillar 232, and a right cutter guide pillar 233; the left cutter guide pillar 231, the middle cutter guide pillar 232 and the right cutter guide pillar 233 are respectively positioned in and slidingly and guidingly matched with the lifting guide hole 221 for the left cutter, the lifting guide hole 222 for the middle cutter and the lifting guide hole 223 for the right cutter; the left cutter 211, the middle cutter 212 and the right cutter 213 are respectively arranged on the top of the left cutter guide pillar 231, the middle cutter guide pillar 232 and the right cutter guide pillar 233.

Figure 3:
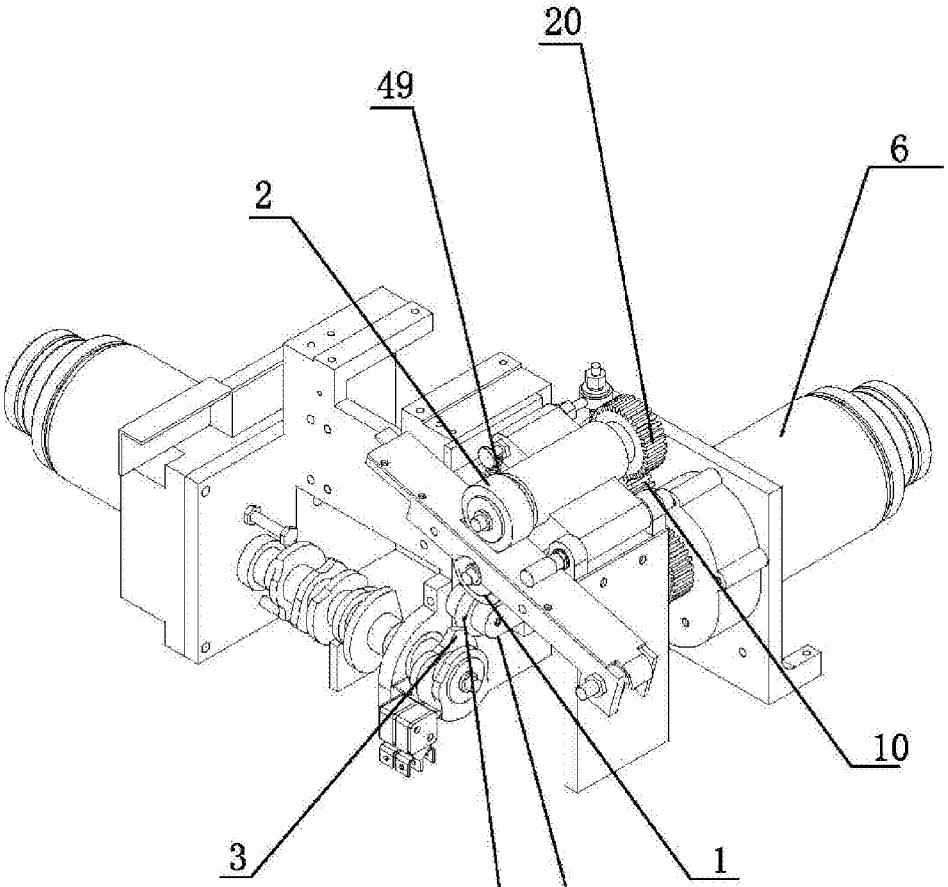
FIG. 3 is a schematic diagram of the embodiment of the belt feeding and retreating and belt tensioning device according to the invention observed from a direction.
Figure 4:
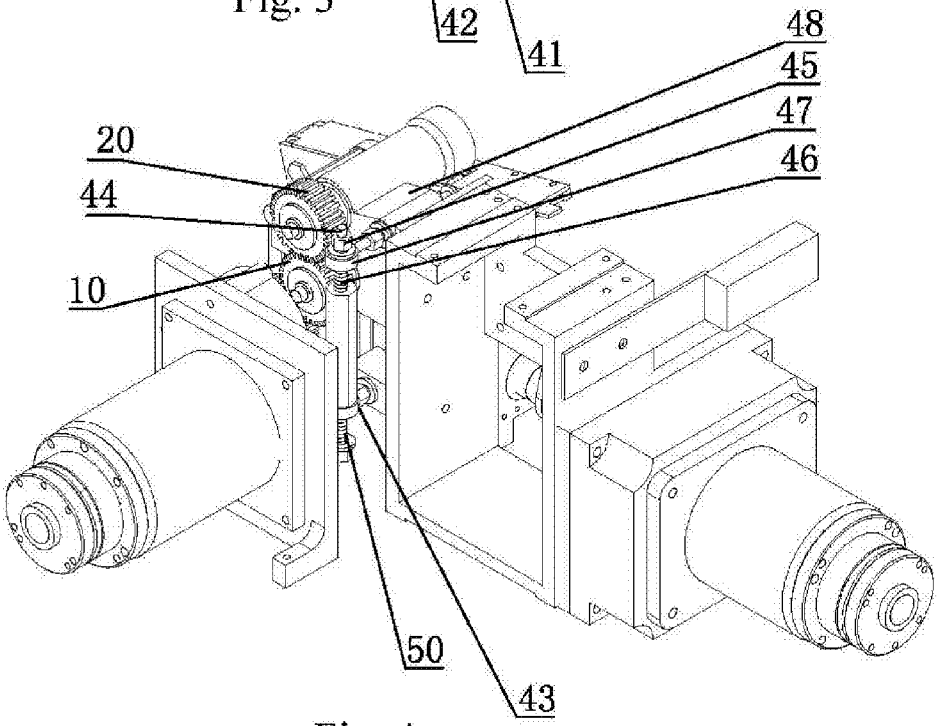
FIG. 4 is a schematic diagram of the embodiment of the belt feeding and retreating and belt tensioning device according to the invention observed from another direction.
Figure 5:
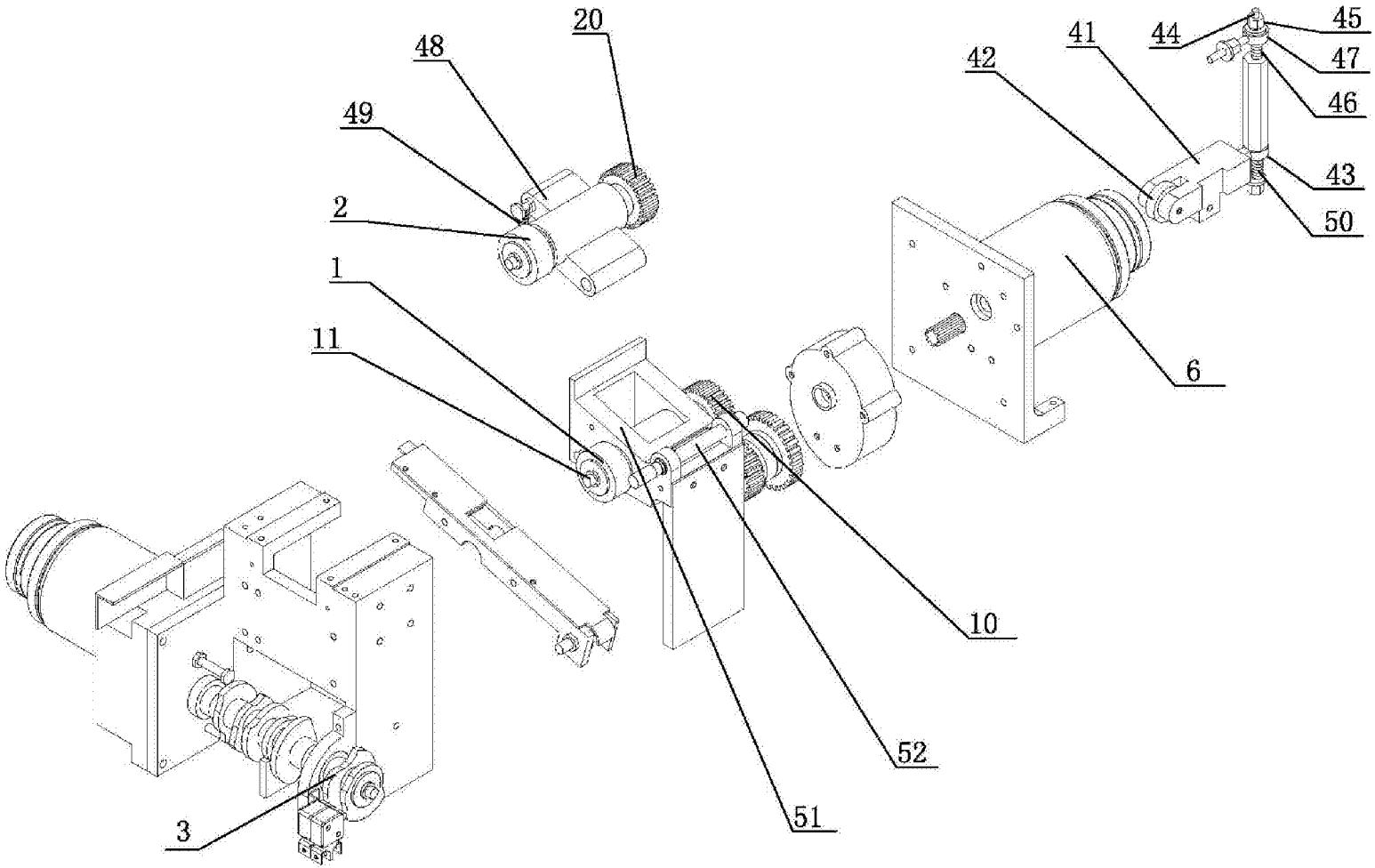
FIG. 5 is a structural explosive view of the embodiment of the belt feeding and retreating and belt tensioning device according to the invention.
Figure 6:
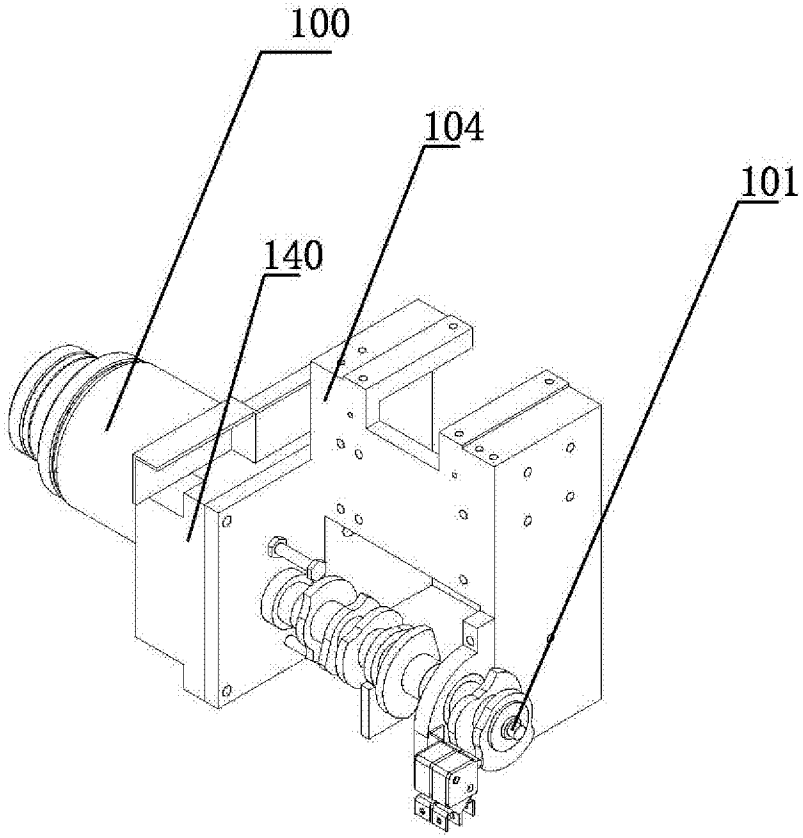
FIG. 6 is a schematic diagram of an embodiment of the decelerating mechanism according to the invention.
Figure 7:
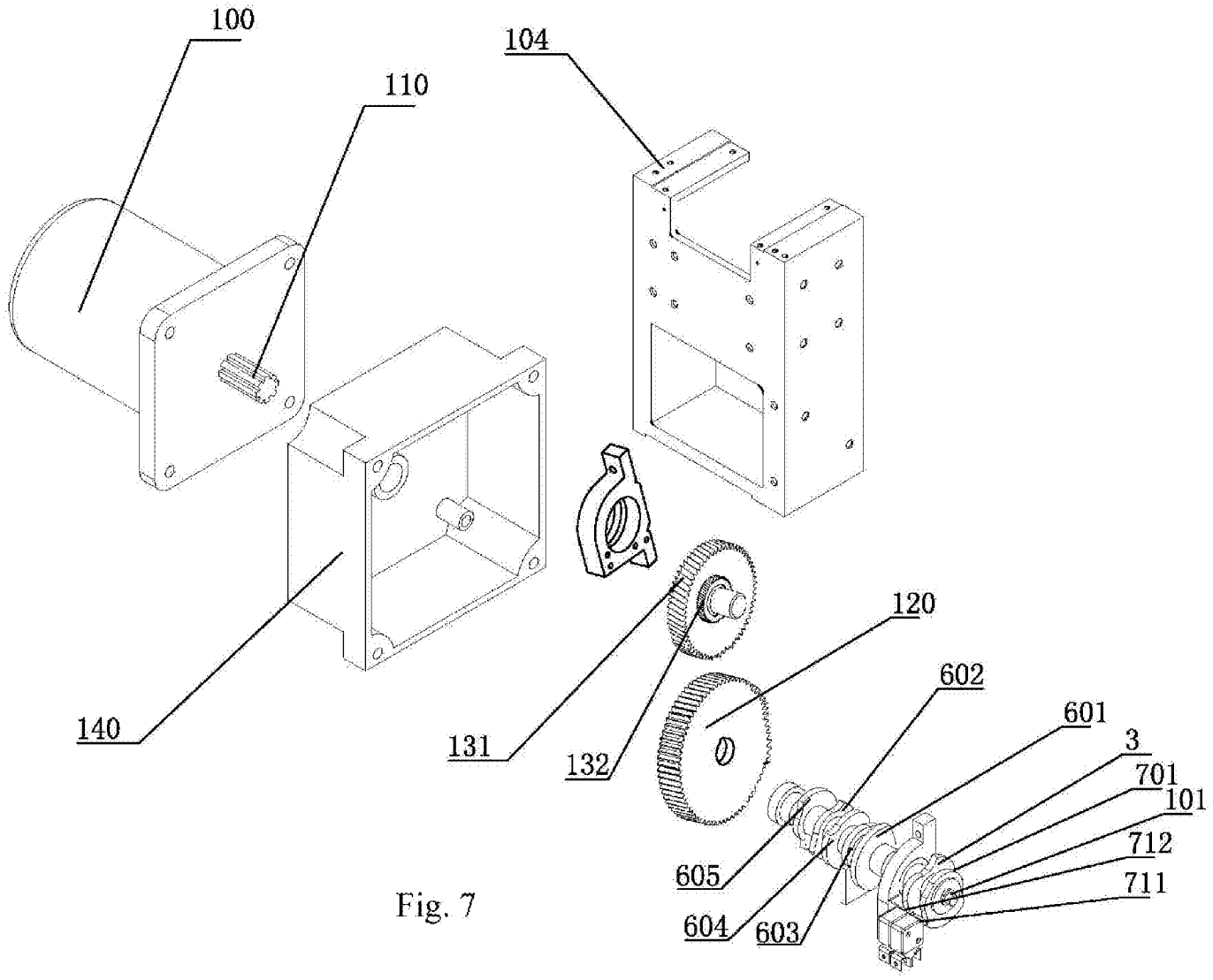
FIG. 7 is an explosive view of the embodiment as shown in FIG. 6.
Figure 8:
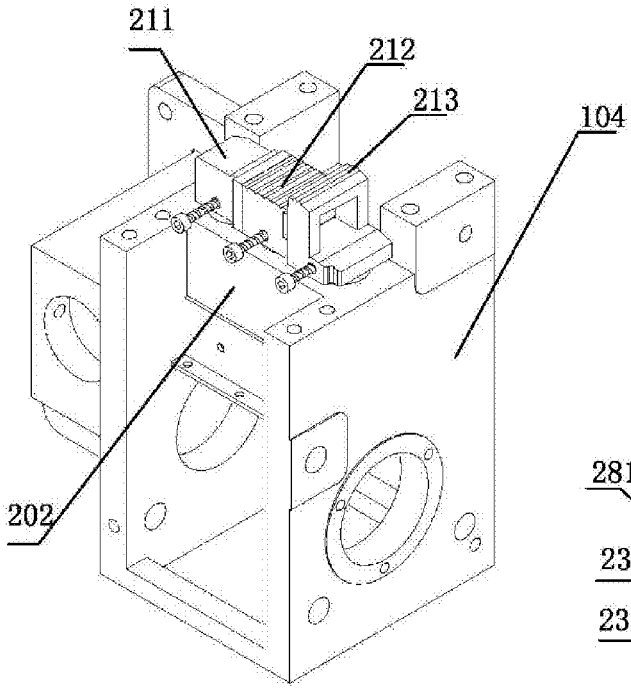
FIG. 8 is a schematic diagram of the strap cutting mechanism being arranged on a machine core rack according to embodiments of the invention.
Figure 10:
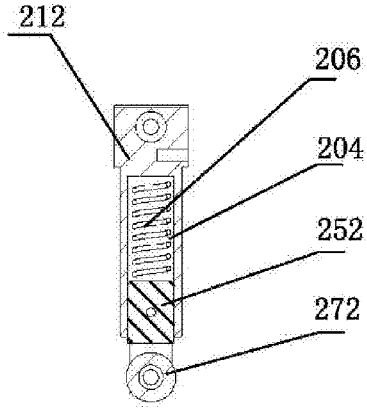
FIG. 10 is a section view regarding the combination state of the middle cutter and the guide pillar thereof.
Figure 9:
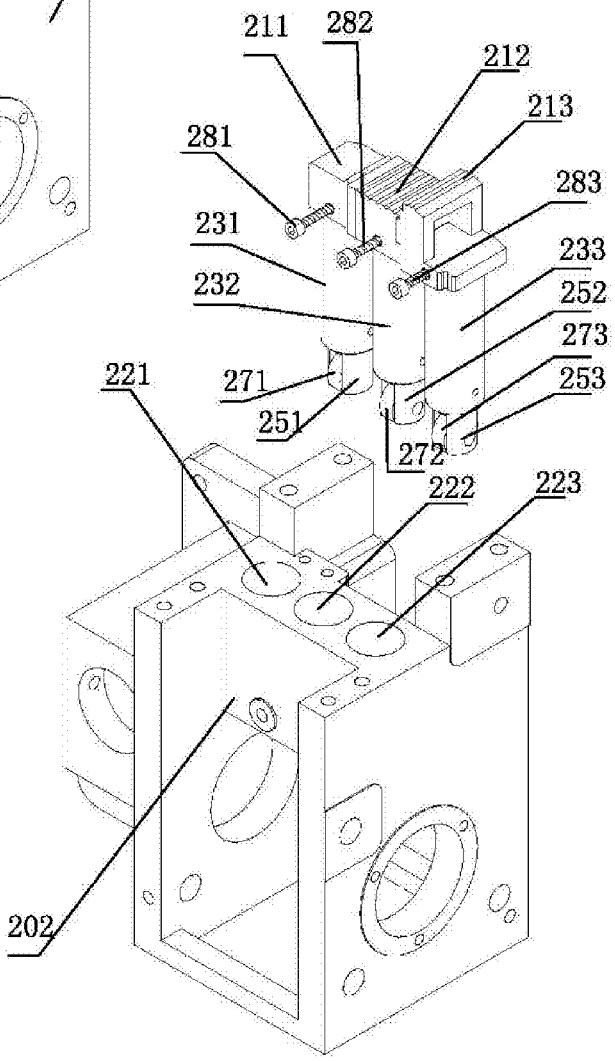
FIG. 9 is an explosive view of the embodiment as shown in FIG. 1.
Figure 11:
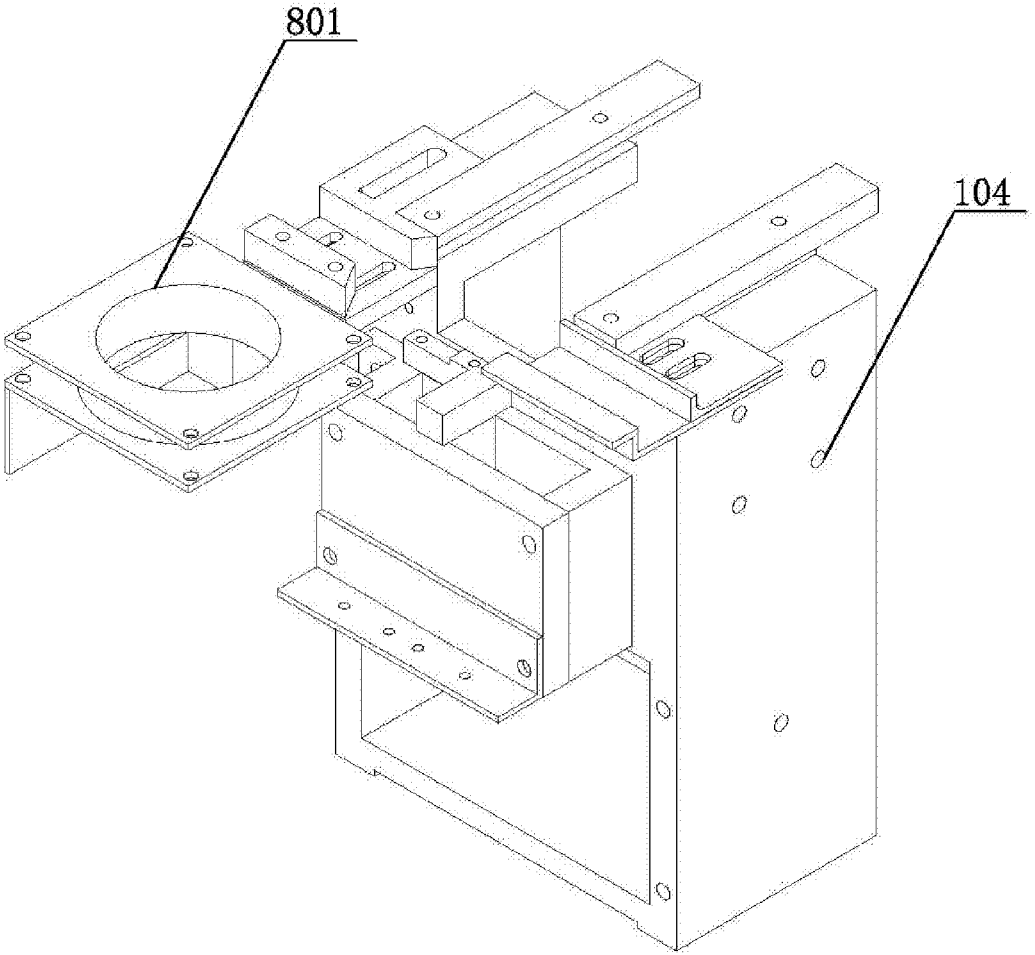
FIG. 11 is a schematic diagram of the machine core mounting rack.

The left cutter guide pillar, the middle cutter guide pillar and the right cutter guide pillar are respectively provided with a mounting hole open downward. Referring to FIG. 3, taking the middle cutter guide pillar as an example, reference drawing number 204 stands for an mounting hole in the middle cutter guide pillar, the left cutter guide pillar and the right cutter guide pillar have similar structures.

The left cutter guide pillar, the middle cutter guide pillar and the right cutter guide pillar are respectively mounted on a lifting drive plunger, reference drawing numbers 251, 252 and 253 respectively stand for the lifting drive plunger of the left cutter guide pillar, the lifting drive plunger of the middle cutter guide pillar and the lifting drive plunger of the right cutter guide pillar. The lifting drive plunger is inserted into the mounting hole; between the lifting drive plunger and the mounting hole is provided with a pressure spring. Referring to FIG. 3, taking the middle cutter guide pillar as an example, reference drawing number 206 stands for a pressure spring, and the left cutter guide pillar and the right cutter guide pillar have similar structures.

Lifting drive plungers 251, 252 and 253 are respectively provided with bearings 271, 272 and 273; relying on motion of cams, the bearings drive the left cutter, the middle cutter and the right cutter to move up or down.

The left cutter, the middle cutter and the right cutter are respectively provided with a connection screw 281, a connection screw 282 and a connection screw 283 which are used for connecting tension springs for operation and resetting.

The mounting column of the left cutter, the mounting column of the middle cutter and the mounting column of the right cutter are respectively controlled by a left cutter cam 602, a middle cutter cam 603 and a right cutter cam 601 for ascending or descending.

By means of the above-mentioned solution, positions of the left cutter, the middle cutter and the right cutter are defined respectively by the lifting guide hole for the left cutter, the lifting guide hole for the middle cutter, and the lifting guide hole for the right cutter; after installation it is unnecessary to adjust positions of the left cutter, the middle cutter and the right cutter; therefore, lifting motion of the left cutter, the middle cutter and the right cutter is stable and accurate, with good repeatability.

The machine core is provided with a dust-collecting fan 801 at a side where the ironing board 401 is arranged and at an end above the machine core and close to the spindle motor so as to collect smoke and dust inside the machine core from the most appropriate position and angle.

Figure 13:
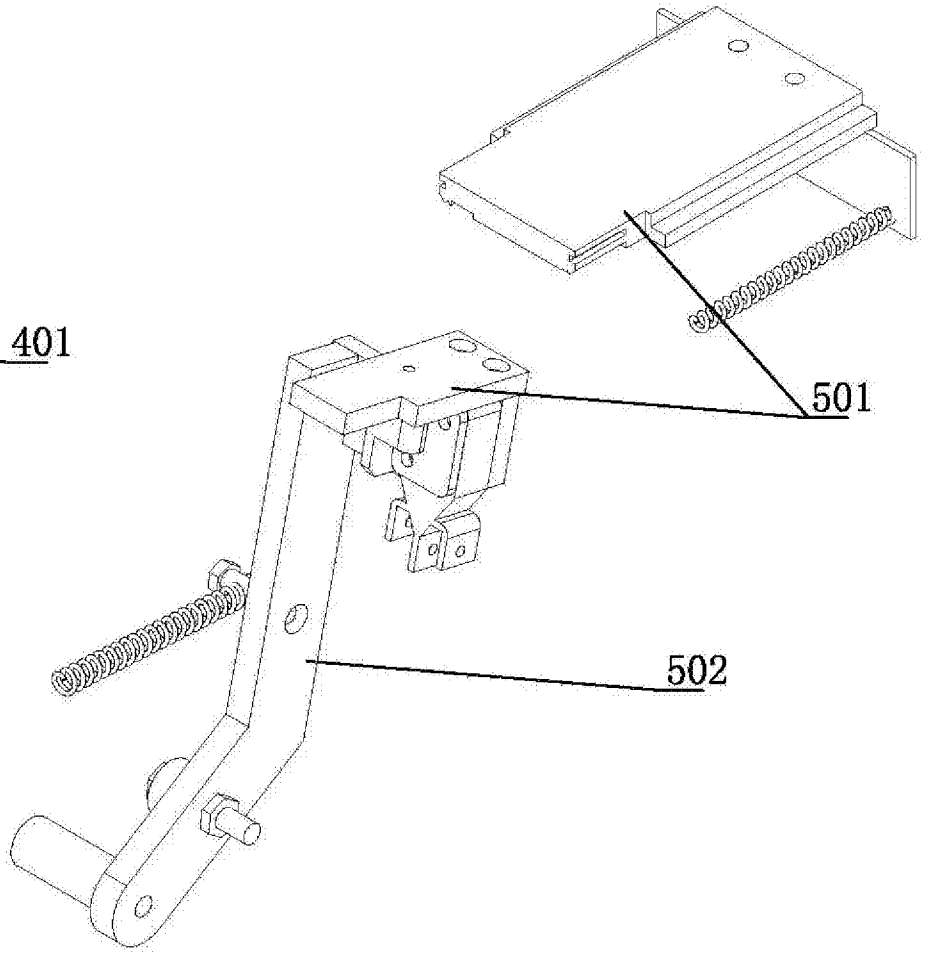
FIG. 13 is an exploded view of the ironing adhering sliding board and swing arms thereof.
Figure 12:
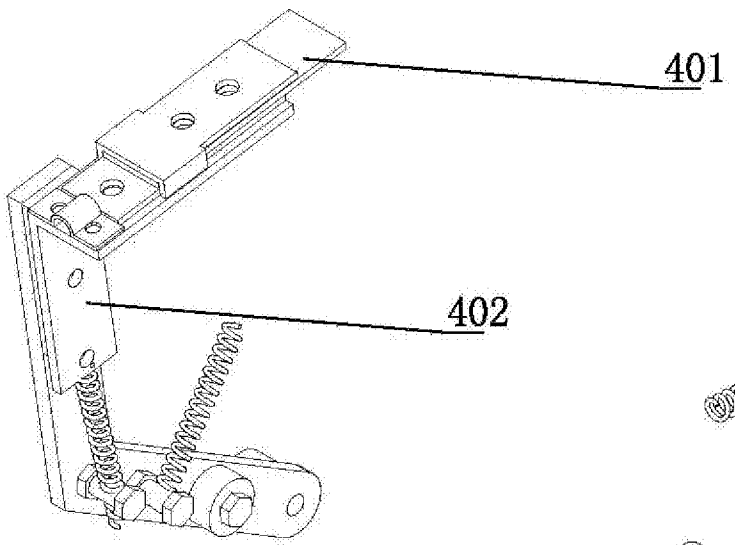
FIG. 12 is a schematic diagram when the ironing board and swing arms thereof are assembled together.

As shown in FIG. 13, reference drawing number 501 stands for the ironing adhering sliding board in the machine core, reference drawing number 502 stands for a swing arm. The ironing adhering sliding board 501 is arranged on the swing arm 502, and swing of the swing arm (i.e., movement of the ironing adhering sliding board) is controlled by a sliding board cam 605.

In the present embodiment, the machine core spindle is further provided with a first inductive cam 701, and the machine core is internally provided with a first inductor 711 matching with the first inductive cam 701 and a second inductor 712 matching with the strap tightening cam 3; signal generated by matching of the first inductive cam 701 with the first inductor 711 is configured to ensure a controller of the control mechanism to control an operation state of the spindle motor 100 and the drive motor 6 of the first roller in a packing cycle, and signal generated by matching of the strap tightening cam 3 with the second inductor 712 is configured to ensure the controller of the control mechanism to control the spindle motor 100 to drive the spindle to reset and to control the drive motor 6 of the first roller to rotate for strap feeding after a packing cycle is completed.

The controller may be a processor with calculation function.

The decelerating mechanism includes a motor shaft gear 110, a first gear 131, a second gear 132 and a machine core spindle gear 120, the motor shaft gear 110 is engaged with the first gear 131, the first gear 131 is coaxial with the second gear 132, the second gear 132 is engaged with the machine core spindle gear 120, the motor shaft gear 110 and the first gear 131 constitute a speed reducing gear pair, and the second gear 132 and the machine core spindle gear 120 constitute a speed reducing gear pair.

As shown in Figs., the packing machine is provided with a machine core mounting rack 104, and the machine core spindle 101 penetrates through the machine core mounting rack 104; both the spindle motor 100 and the decelerating mechanism are positioned outside one side of the machine core mounting rack 104, and the decelerating mechanism is externally provided with a housing 140; a plurality of cams 601, 602, 603, 604 and 605 for controlling the ironing adhering and strap cutting mechanism and the ironing adhering sliding board mechanism are positioned on the machine core spindle in the machine core mounting rack, and the strap tightening cam 3, the first inductive cam 701 and the strap tightening cam 3 are arranged on the machine core spindle positioned outside one side of the machine core mounting rack. In this way, the packing machine is convenient to install, the size of the machine core is reduced, and the operational stability of the machine core spindle 101 is improved.

In the present embodiment, the control mechanism controls movement of mechanical motion mechanisms in the machine core by way of cams. It is also possible to adopt other control modes as long as they can control these mechanical motion mechanisms to work.

The following is the working process of the machine core: a strap is inserted manually to switch on-the spindle motor 100 is turned on;

under the control of the right cutter cam 601, the right cutter withstands a strap head at the sliding board 501;

the swing arm 502 is controlled by the sliding board cam 605 to retreat;

under the control of the strap tightening cam 3, the second roller 2 and the first roller 1 are at the first matching state, and the second transmission gear 20 enters into the first gear matching state; the first inductive cam 701 inducts the inductor 711, a strap returning switch is switched on, the spindle motor 100 stops, and the drive motor 6 is switched on to contrarotate;

after the strap retreats onto an article strapped, when a detected current value of the drive motor 6 is greater than a setting current value, the spindle motor 100 is switched on once again;

under the control of the left cutter cam 602, the left cutter 211 withstands the strap at the sliding board 501;

the first inductive cam 701 switches the inductor 711 off, and the drive motor 6 stops;

the ironing board cam 604 controls movement of the swing arm 402, and the ironing board 401 is inserted between two layers of straps;

under the control of the middle cutter cam 603, the middle cutter 212 pushes up, cuts the strap, and withstands the strap and the ironing board 401 until the upper and the lower layers of the strap are melted on surface;

the first inductive cam 701 inducts the inductor 711 once again, the drive motor 6 is switched on to contrarotate and the strap head is retreated somewhat;

under the control of the middle cutter cam 603, the middle cutter 212 descends, the ironing board cam 604 controls movement of the swing arm 402, and the ironing board 401 retreats out;

under the control of the middle cutter cam 603, the middle cutter 203 pushes up once again, withstands tightly the strap at the sliding board 501 so that the strap is adhered tightly;

the first inductive cam 701 switches the inductor 711 off once again; the spindle motor stops, and ironing adhering delay is switched on; the spindle motor is switched on once again after the delay is over;

under the control of the left cutter cam, the middle cutter cam and the right cutter cam, the left cutter, the middle cutter and the right cutter respectively descend;

the swing arm 502 is controlled by the sliding board cam 605 to retreat again to drive the sliding board to retreat to eject the strap out;

the swing arm 502 is controlled by the sliding board cam 605 to come back in situ, and the sliding board comes back in situ;

the strap tightening cam 3 inducts the inductor 712, and an in-situ switch is switched on; the spindle motor stops and is instantaneously braked; mechanisms of the machine core come back in situ to get ready for a next working cycle; the drive motor 6 is switched on to rotate to feed the strap, in this way a working cycle is completed.

The invention claimed is:

1. A machine core of a packing machine, comprising:

a packing strap ironing adhering and strap cutting mechanism;

and an ironing adhering sliding board mechanism;

wherein the machine core is further provided with a strap feeding and returning and strap tightening device comprising an unmovable first roller and a movable second roller, the second roller is controlled by a control mechanism to move to a first matching state with the first roller and to move out of the first matching state with the first roller to a second matching state, the first matching state is a state in which the second roller and the first roller are in contact with and cooperating with one another for strap returning and tightening, and the second matching state is a state in which the second roller and the first roller are in contact with and cooperating with one another for strap feeding; the first roller is connected with a first transmission gear capable of driving the first roller to rotate, the second roller is connected with a second transmission gear capable of driving the second roller to rotate, and the second transmission gear synchronously shifts with the second roller; the first transmission gear takes in power through a gear transmission mechanism to drive the first roller to rotate, the second transmission gear takes in power through the gear transmission mechanism; the second transmission gear moves into a first gear matching state which is a meshing state, and moves out of the first gear matching state to enter an out-of-gear state or a meshing state looser than the first gear matching state; and the power is supplied by a drive motor, wherein the control mechanism comprises a machine core spindle and a spindle motor, and the machine core spindle is provided with a strap tightening cam for controlling the second driven roller to move, wherein the second transmission gear and the second roller are arranged in a swing system, and the strap tightening cam controls the second transmission gear and the second roller to move by means of the swing system having a reset spring, a regulating spring and a stretched spring, wherein the swing system comprises a first swing arm which is provided with a roller matching with the strap tightening cam, wherein the first swing arm is connected with a pull rod by means of a lower cardan connector, the pull rod is sleeved with the regulating spring which may be regulated by a nut on the pull rod, the regulating spring acts on an upper cardan connector to regulate force tightening the packing strap, the upper cardan connector is connected with a second swing arm, the second transmission gear and the second roller are arranged on the second swing arm, the second swing arm is connected to the stretched spring, and the reset spring acts on the first swing arm by means of the lower cardan connector.

2. The machine core of the packing machine according to claim 1, wherein the drive motor first inputs power to the first transmission gear through gear reduction transmission, and then transmits the power from the first transmission gear to the second transmission gear through tooth mesh.

3. The machine core of the packing machine according to claim 1, wherein the machine core spindle is provided with a plurality of controlling cams for controlling the ironing adhering and strap cutting mechanism and the ironing adhering sliding board mechanism, and the spindle motor drives the machine core spindle to rotate by means of a decelerating mechanism.

4. The machine core of the packing machine according to claim 1, wherein the strap feeding and returning and strap tightening device is further provided with a rack, a shaft between the first transmission gear and the first roller passes through the rack, a shaft of the second swing arm is also arranged on the rack, the second swing arm is positioned above the shaft between the first transmission gear and the first roller; the second roller and the second transmission gear are respectively positioned above the first roller and the first transmission gear, the first transmission gear is meshed with the second transmission gear, and is a gear for transferring power to the second transmission gear.

5. The machine core of the packing machine according to claim 1, wherein the machine core spindle is further provided with a first inductive cam, and the machine core is internally provided with a first inductor matching with the first inductive cam and a second inductor matching with the strap tightening cam; signal generated by matching of the first inductive cam with the first inductor is configured to ensure a controller of the control mechanism to control an operation state of the spindle motor and the drive motor of the first roller in a packing cycle, and signal generated by matching of the strap tightening cam with the second inductor is configured to ensure the controller of the control mechanism to control the spindle motor to drive the spindle to reset and to control the drive motor of the first roller to rotate for strap feeding after a packing cycle is completed.

6. The machine core of the packing machine according to claim 3, wherein the decelerating mechanism comprises a motor shaft gear, a first gear, a second gear and a machine core spindle gear, the motor shaft gear is engaged with the first gear, the first gear is coaxial with the second gear, the second gear is engaged with the machine core spindle gear, the motor shaft gear and the first gear constitute a speed reducing gear pair, and the second gear and the machine core spindle gear constitute a speed reducing gear pair.

7. The machine core of the packing machine according to claim 5, wherein the packing machine is provided with a machine core mounting rack, and the machine core spindle penetrates through the machine core mounting rack; both the spindle motor and the decelerating mechanism are positioned outside one side of the machine core mounting rack, and the decelerating mechanism is externally provided with a housing; the plurality of controlling cams for controlling the ironing adhering and strap cutting mechanism and the ironing adhering sliding board mechanism are positioned on the machine core spindle in the machine core mounting rack, and the strap tightening cam and the first inductive cam are arranged on the machine core spindle positioned outside one side of the machine core mounting rack.

8. The machine core of the packing machine according to claim 7, wherein the machine core is provided with a dust-collecting fan at a side where an ironing board is arranged and at an end above the machine core and close to the spindle motor, and the dust-collecting fan has an upward air-sucking direction.

* * * * *